US008240967B2

(12) United States Patent
Guglielmelli et al.

(10) Patent No.: US 8,240,967 B2
(45) Date of Patent: Aug. 14, 2012

(54) SELF-FEEDING APPARATUS

(75) Inventors: Eugenio Guglielmelli, Rome (IT); Giuseppina Anna Di Lauro, Pisa (IT); Federico Chiarugi, Pisa (IT); Giacomo Giachetti, Pisa (IT); Yves Perrella, Milan (IT); Andrea Pisetta, Leghorn (IT); Andrea Scoglio, Pisa (IT)

(73) Assignee: Scuola Superiore di Studi Unviersitari e di Perfezionamento Sant'Anna, Pisa (IT)

( * ) Notice: Subject to any disclaimer, the term of this patent is extended or adjusted under 35 U.S.C. 154(b) by 611 days.

(21) Appl. No.: 11/921,213

(22) PCT Filed: May 26, 2006

(86) PCT No.: PCT/IT2006/000397

§ 371 (c)(1),
(2), (4) Date: Nov. 27, 2007

(87) PCT Pub. No.: WO2006/126239

PCT Pub. Date: Nov. 30, 2006

(65) Prior Publication Data

US 2009/0104004 A1 Apr. 23, 2009

(30) Foreign Application Priority Data

May 27, 2005 (IT) ..... FI2005A0117

(51) Int. Cl.
*A47G 21/00* (2006.01)
*A47G 21/08* (2006.01)

(52) U.S. Cl. ..... 414/9; 901/16; 340/825.19; 623/65

(58) Field of Classification Search ..... 108/28; 340/825.16; 414/1–2, 4, 7, 706, 9; 604/57; 606/130; 623/65; 901/16, 41
See application file for complete search history.

(56) References Cited

U.S. PATENT DOCUMENTS

| | | | | |
|---|---|---|---|---|
| 1,333,209 | A * | 3/1920 | Maguire | 414/9 |
| 3,391,830 | A * | 7/1968 | Kitchens | 222/132 |
| 4,229,136 | A * | 10/1980 | Panissidi | 414/673 |
| 4,433,950 | A | 2/1984 | Hanger et al. | 414/9 |

(Continued)

FOREIGN PATENT DOCUMENTS

| | | |
|---|---|---|
| FR | 2692460 | 12/1993 |

(Continued)

*Primary Examiner* — Gregory W Adams
(74) *Attorney, Agent, or Firm* — Steinfl & Bruno LLP

(57) ABSTRACT

A self-feeding apparatus for the disabled and elderly, which comprises: a support base; a holder for an open food container, pivotally connected to the base; an article for scooping food from the container; a system for moving the scooping article from a food scooping position from the container and a food dispensing position at a selected height from the base corresponding to the user's mouth. The system includes a first arm slantingly extending from the base and a second arm, arranged in a substantially horizontal position and slidably mounted on the first arm, the food scooping article being slidably mounted on the second arm. A motor is further provided for sliding the second arm along the first arm and the food scooping article along the second arm and for rotating the food container holder. At least one tank for liquid or semi liquid food and for beverages is placed on the base and a conveyor is provided for transporting the food from the tank to the user's mouth. The apparatus also has a programming and control system that includes a mouth operable control at the outlet end of the conveyor.

16 Claims, 8 Drawing Sheets

U.S. PATENT DOCUMENTS

| | | | | | |
|---|---|---|---|---|---|
| 4,783,656 | A | * | 11/1988 | Katz et al. | 340/825.19 |
| 4,871,154 | A | * | 10/1989 | Seney | 269/97 |
| 5,037,261 | A | | 8/1991 | Morewood | 414/9 |
| 5,126,731 | A | * | 6/1992 | Cromer, Jr. | 340/825.19 |
| 5,282,711 | A | * | 2/1994 | Frische | 414/9 |
| 5,417,210 | A | * | 5/1995 | Funda et al. | 600/425 |
| 5,518,081 | A | * | 5/1996 | Thibodeau | 180/210 |
| 5,934,141 | A | * | 8/1999 | Costa | 74/89.17 |
| 6,592,315 | B2 | * | 7/2003 | Osborne, Jr. | 414/9 |
| 2002/0064438 | A1 | | 5/2002 | Osborne, Jr. | 414/9 |
| 2007/0217891 | A1 | * | 9/2007 | Folcik | 414/9 |

FOREIGN PATENT DOCUMENTS

| | | |
|---|---|---|
| JP | 09224965 | 9/1997 |
| JP | 2004008327 | 1/2004 |
| JP | 2004081567 | 3/2004 |
| WO | WO 9307788 | 4/1993 |

* cited by examiner

SELF-FEEDING APPARATUS

FIELD OF THE INVENTION

The present invention relates generally to medical devices and, more particularly, to an apparatus for assisting the elderly and disabled.

BACKGROUND OF THE INVENTION

Many devices and apparatuses have been developed to provide a selected degree of independence to people with various degrees of physical and mental disability, particularly during eating. Such devices and apparatuses have ranged from low-tech devices, for instance, those known commercially as the "Eatery" to robotic hi-tech systems, e.g., those sold under the names "Handy 1" and "My Spoon". While useful, their specific design goals differ generally from one system or device to another. In some, an objective is to provide either a low-cost and easily manufactured device or one that is small, portable and easy-to-use device. In other cases, the focus has been more on modularity and adaptability to the user needs. Traditional systems and devices have also differed from one another in their user interface, control structure, mechanical form and artifacts, and the levels of user involvement in device (or system) operation.

Generally speaking, the self-feeding apparatuses both of the commercial type and research prototypes may be categorized into two groups: (i) body-controlled feeders (i.e., those controlled by a user's body part such as a mouth, a hand, or a foot), where the user controls directly all the steps of the eating process; and (ii) automatically controlled feeders, where the user activates a switch or some type of mechanism to initiate all or part of a pre-programmed eating cycle.

Automatic feeders are mechanically more complex, with simple to complex embedded electronics and control systems, and automate a part of, or all of, the process of selecting, getting a portion of food and offering it to the user. Usually, the feeders use a spoon utensil to scoop the food and some mechanism to transport the food-filled utensil to a predetermined position where the user can eat it. Often users must at least have the capacity to move body and/or head forward to take food off the spoon and must be cognitively able to differentiate between the switches. The advantage of these powered feeders is in their ability to allow users with more severe disability to operate them with minimum effort and with any residual movement available. The disadvantage is in their increased mechanical and electrical complexity, which results in a feeding device with greater safety risks to the user.

The most common automatic feeders are the Arm Feeders which often have 1 or 2 degree-of freedom mechanical arms with a tool attachment that can be lowered to a movable plate or bowl to scoop food and raised to a fixed position at the height of the user's mouth. Three commercial examples of Arm Feeders are the Winsford feeder, the Neater Eater feeder and the ADD (Assistance Dining Device) feeder. These feeders are equipped with arm mechanisms that are able to get food from one location only and as such it is required to provide for a degree of freedom (DOF) in the food container. Therefore, the typical Arm Feeder has a total of 3 DOF: 2 DOF in the arm and 1 DOF in the rotating or translating plate. For example, the 2 DOF arm of the ADD feeder rotates to scoop food from one of the three food bowls that have been rotated into position to allow the arm have access to the food and, later, translates to offer the food to the user. On the other hand, the arm of the Neater Eater feeder rotates downwardly under a 2 DOF cable drive mechanism to scoop food from a plate that has been rotated to access to food in a specific position on the plate and, later, rotates upwardly to offer the food.

Robotic Feeders can be categorized as more sophisticated Arm Feeders. They are designed with servo-controlled arms with higher degrees of freedom (3 to 6 DOF). Unlike the regular arm feeders, they do not require a moving food container since their increased DOF's permit them more flexible methods for retrieving the food from the plate. Two examples of alternate food retrieval methods can be seen in the 4 DOF, Handy 1 Robot, which scoops food with a flat-tipped spoon from one of seven compartments of a fixed plate, and the 5 DOF, My Spoon Robot, which grasps solid food with a spoon and fork hand mechanism from compartments in a Japanese lunch box. Also, as a result of higher DOF, some of these robotic systems are able to offer users the ability to perform other self-care activities of daily living (ADLs) in addition to feeding. Examples of these are the 6 DOF, DeVAR prototype system that permits users to shave and brush their teeth and the Handy 1 commercial system that permits users to make-up their face.

The MySpoon robotic feeding system (marketed by the Japanese company Secom Co. Ltd.) is the system that implements the more flexible arm mechanism in a small non-invasive package. It has implemented a novel mechanism for selecting particular pieces of food. On the other hand, the Neater Eater (of the English company Neater Solutions Ltd.) has the more flexible and modular system that allows it to serve a large variety of users. The fact that the system is modular means that it is easily reconfigurable (e.g. the arm can be separated from the base and the end-effectors can be replaced). The possibility of using regular plate and spoon makes it more familiar. Finally, the ADD (of the US company Meal Time Partners, corresponding to U.S. Pat. No. 5,282,711) has the best system for handling semi-liquid and liquid substances with minimum spills, a very flexible system for presenting food to the user and a very safe, force-feedback system governing the interaction of the device with the user.

Other types of automatic feeders are also known that do not have an arm configuration. For example, the devices according to U.S. Pat. Nos. 4,162,868 and 4,624,613 comprise mechanisms with one or two degrees of freedom with a spoon that translate to scoop and dispense food at a fixed position close to the user's mouth. Food is moved by another mechanism on the spoon. According to U.S. Pat. No. 4,162,868 a cam mechanism moves food in the spoon dispensing it to the user. According to U.S. Pat. No. 4,624,613 pressurized food is dispensed in a pneumatically moved spoon.

Despite their effectiveness the commercially available self-feeders for disabled people are still not being utilized in large numbers. As a matter of fact, these are still too expensive, too difficult to use, unreliable, inconvenient, difficult to transport, unattractive and too time-consuming in set up. It has been noticed that, even in those case wherein the operating effectiveness is higher, they are unable to meet the needs of users with minimum head and trunk control, i.e. with the most severe disability degree.

OBJECTS AND SUMMARY OF THE INVENTION

Accordingly, it is an object of the present invention to provide a self-feeding apparatus for disabled users and the elderly, that operates both at a base level to perform the function of a nurse assistant in feeding people with severe spine lesions and at an higher level to involve the user in the feeding process, focusing not only on her/his residual abilities, but also offering opportunities for the rehabilitation and diagnosis.

A particular object of the present invention is to provide an apparatus of the above mentioned type capable of meeting several functional needs in the feeding field and usable by various user types (severely disabled people, elderly persons, children).

A further object of the present invention is to provide an apparatus of the above mentioned type that, contrary to the commercially available apparatuses, would be featured by a non-invasive, familiar appearance, such that of an household appliance, being able, inter alia, to use regular plates and cutlery.

Still another object of the present invention is to provide an apparatus of the above mentioned type that would be of the easily transportable type and usable in different situation, also thanks to an autonomous battery power source.

An additional object of the present invention is to provide an apparatus of the above mentioned type wherein the user would be able to select the requested function through a mouth-actuated device through which liquids and semisolid food can be fed as an usual drinking straw.

These objects are achieved with the apparatus for the self-feeding of disabled users and elderly people whose essential features are set forth in claim 1.

BRIEF DESCRIPTION OF THE DRAWINGS

A specific, illustrative self-feeding apparatus for disabled users and the elderly, according to the present invention, is described below with reference to the accompanying drawings, in which.

Figure 1:
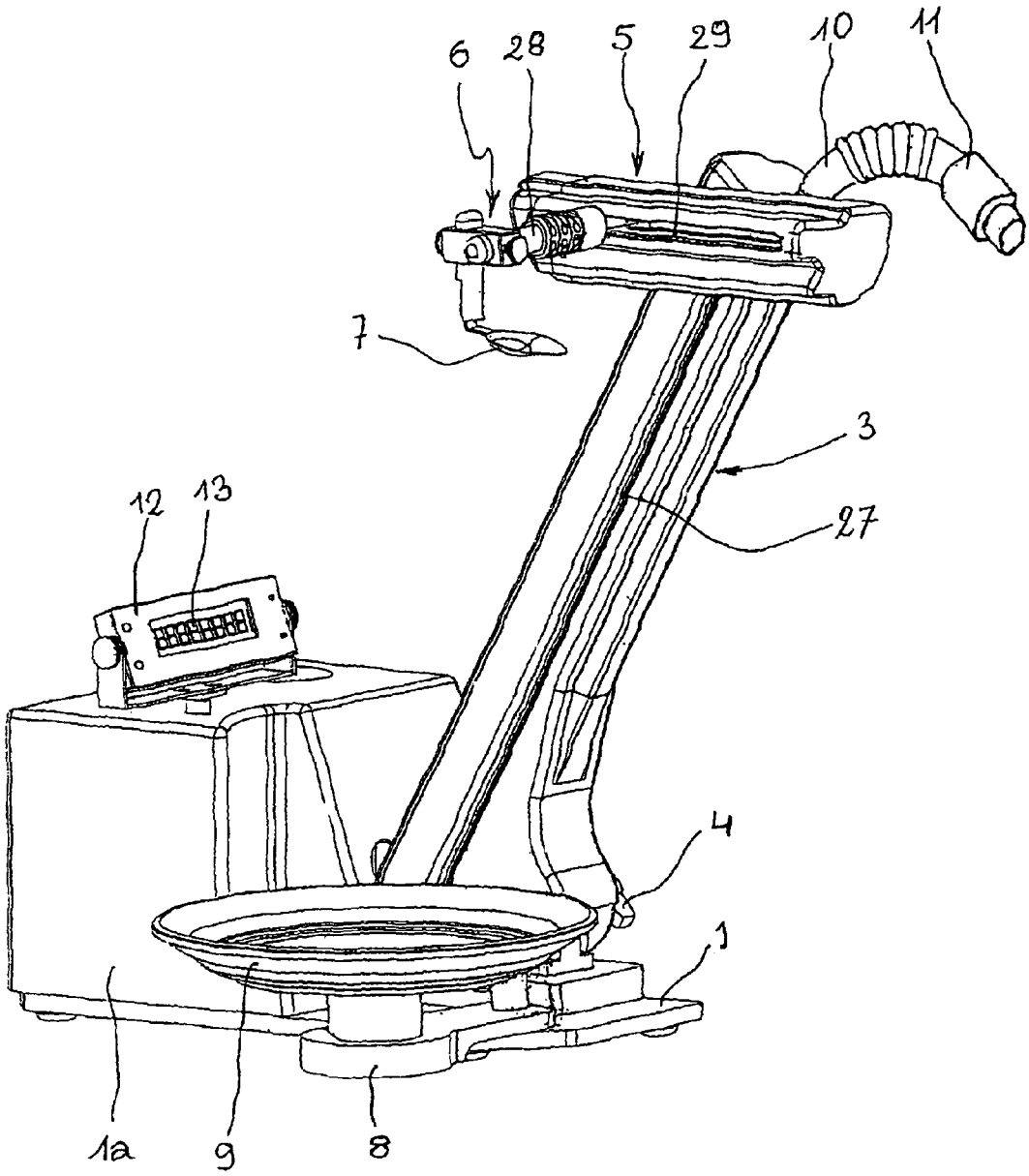
FIG. 1 is a perspective view of self-feeding apparatus, according to one aspect of the present invention.
Figure 4:
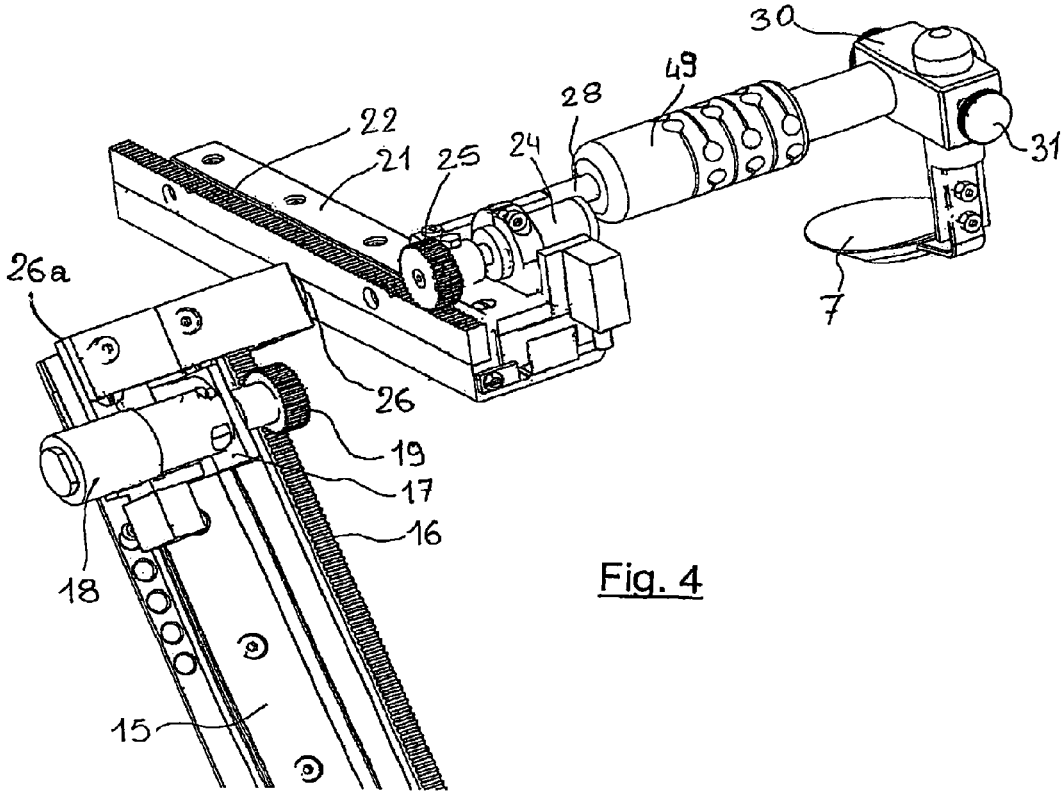
Figure 5:
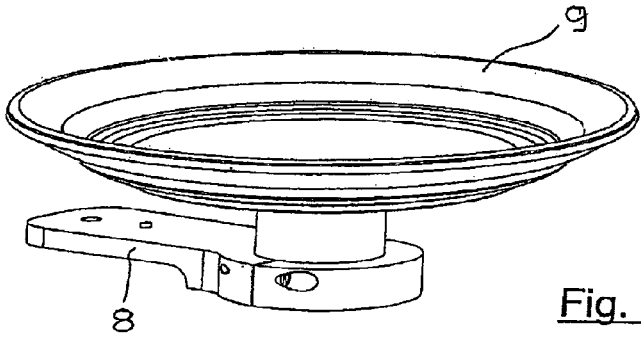
Figure 6:
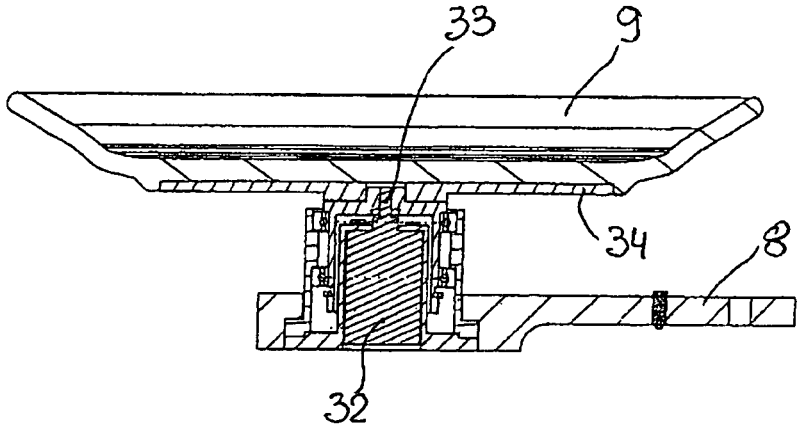
Figure 7:
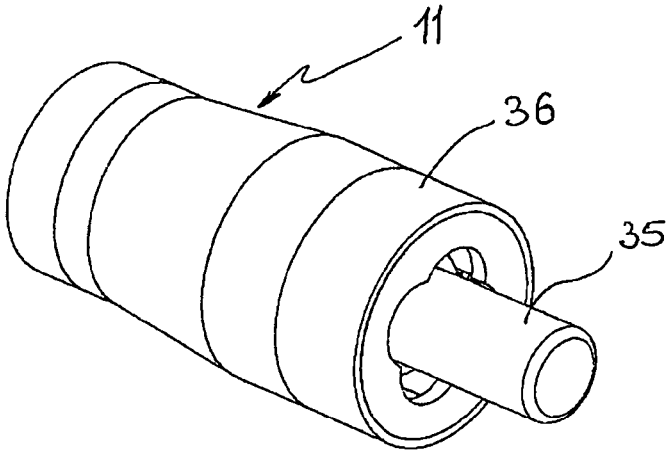
Figure 8:
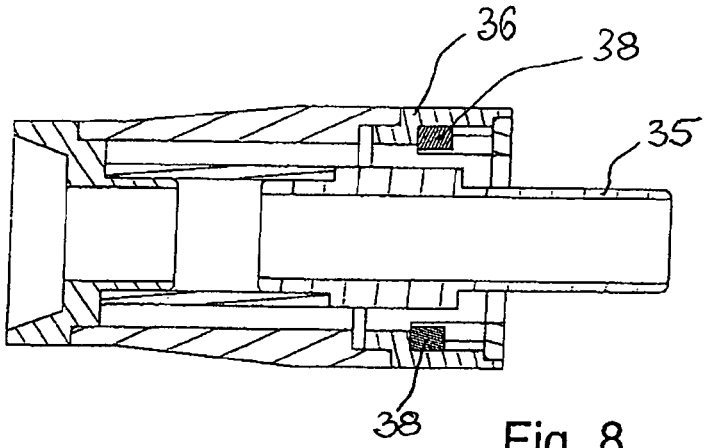
Figure 9:
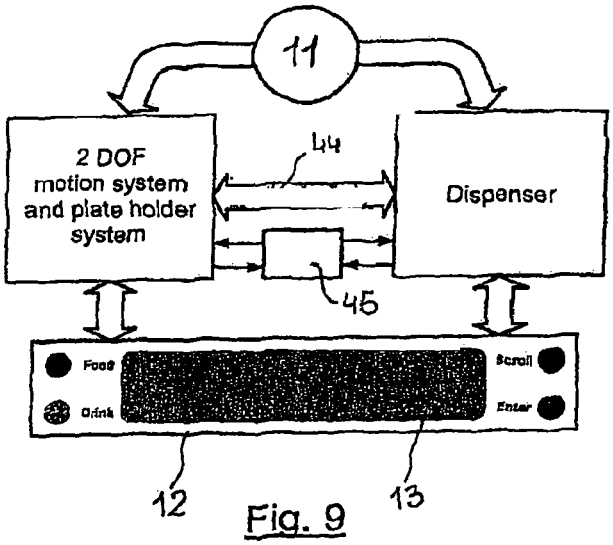
Figure 10:
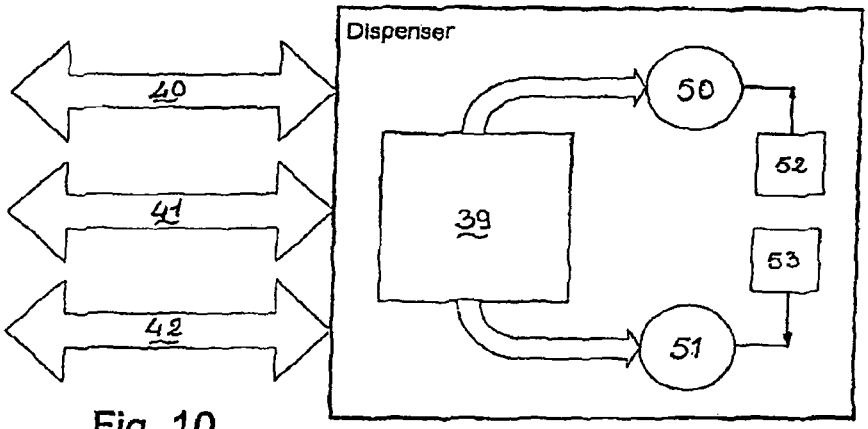
Figure 11:
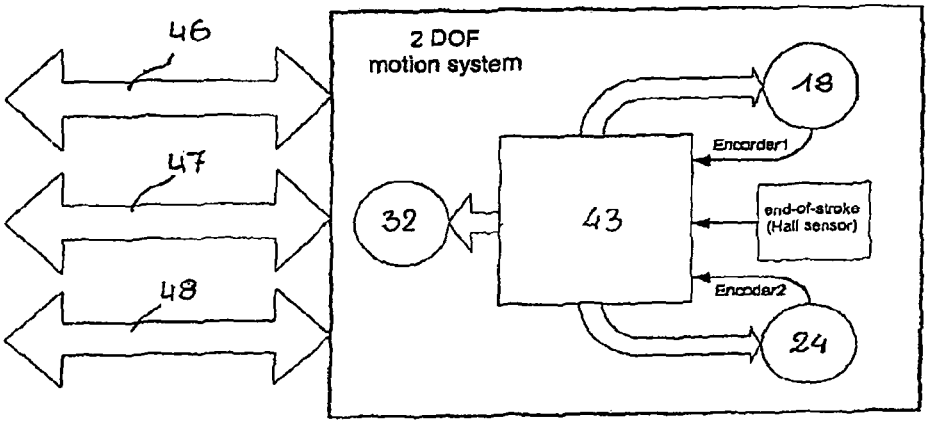
Figure 12:
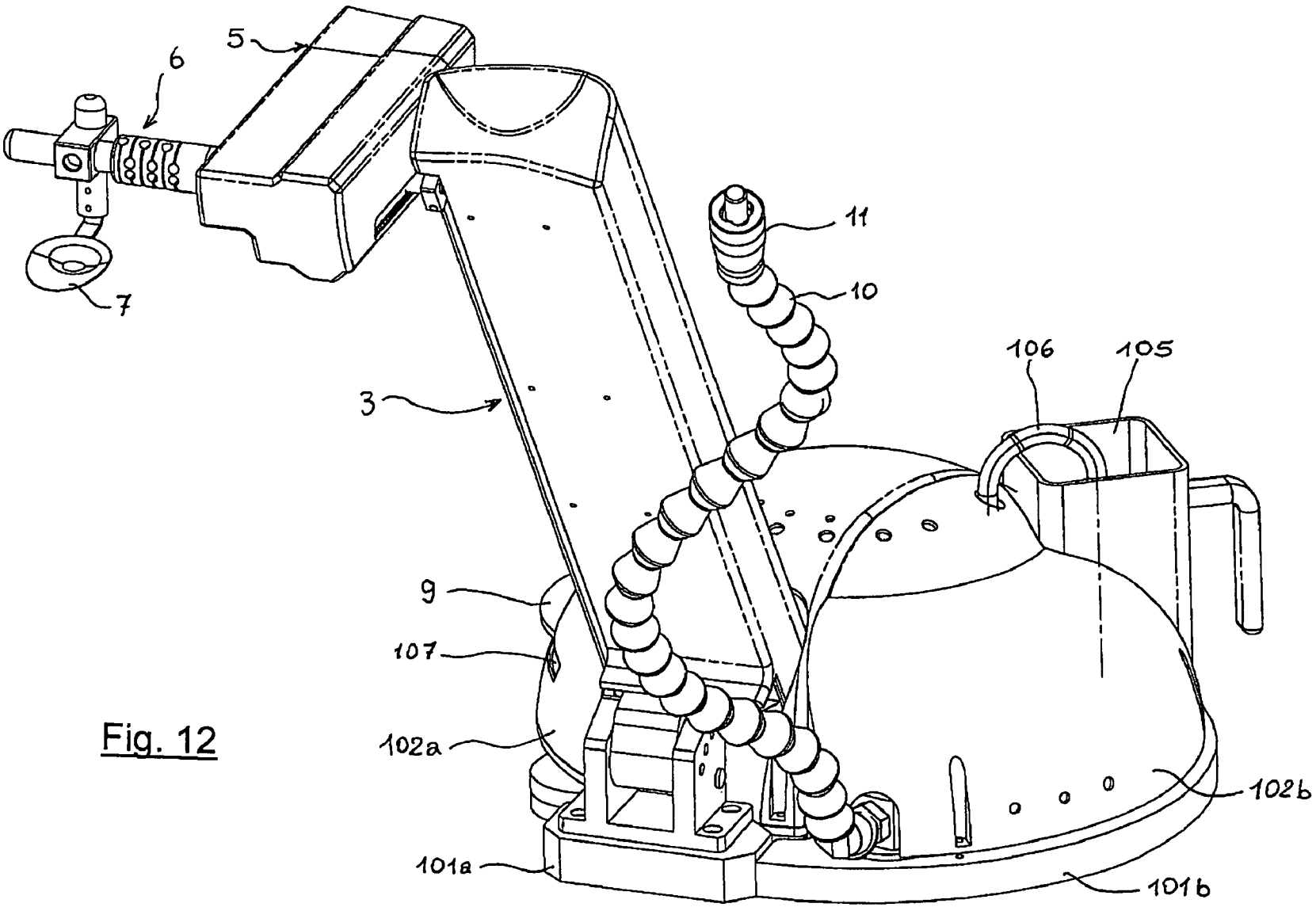
Figure 13:
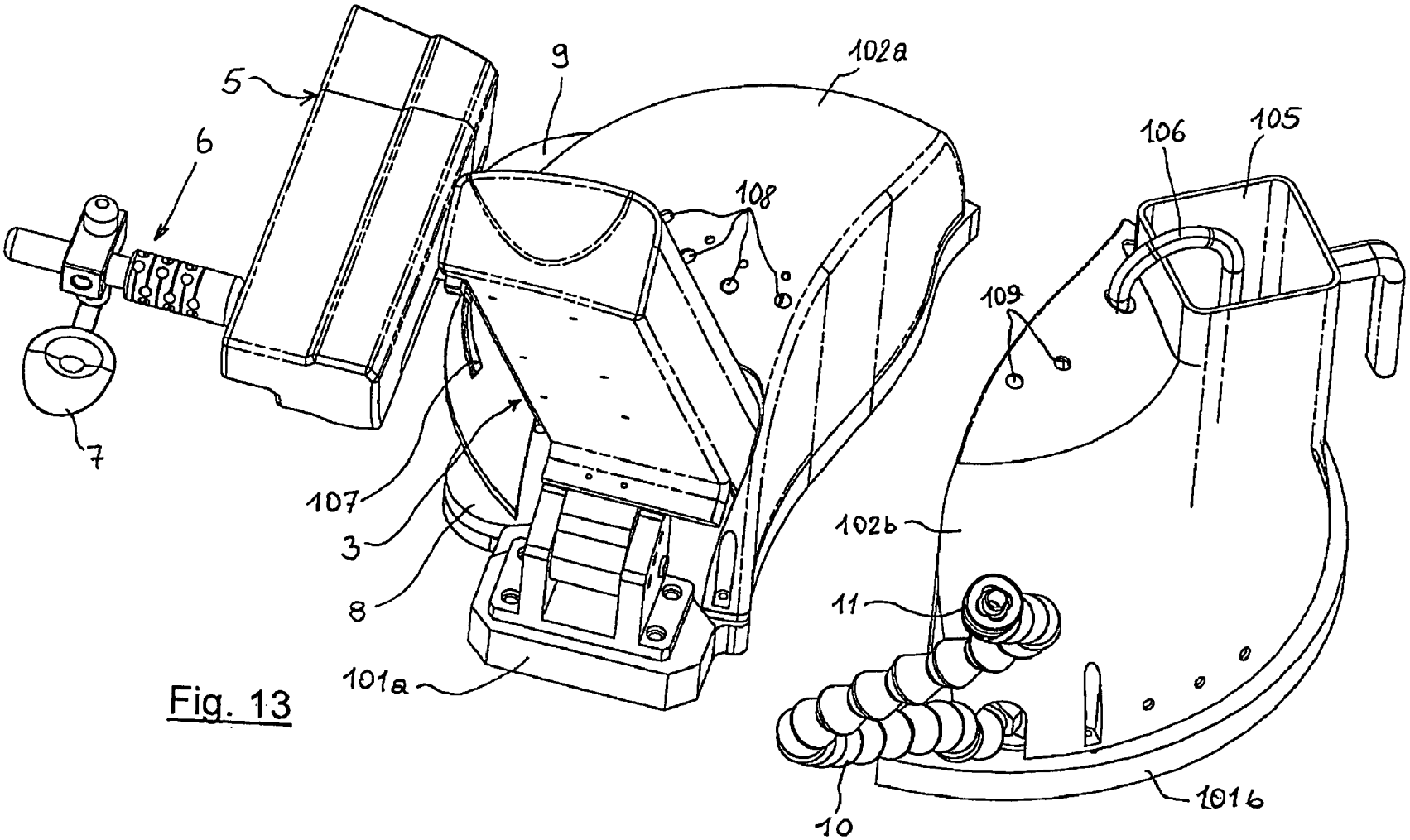
Figure 14:
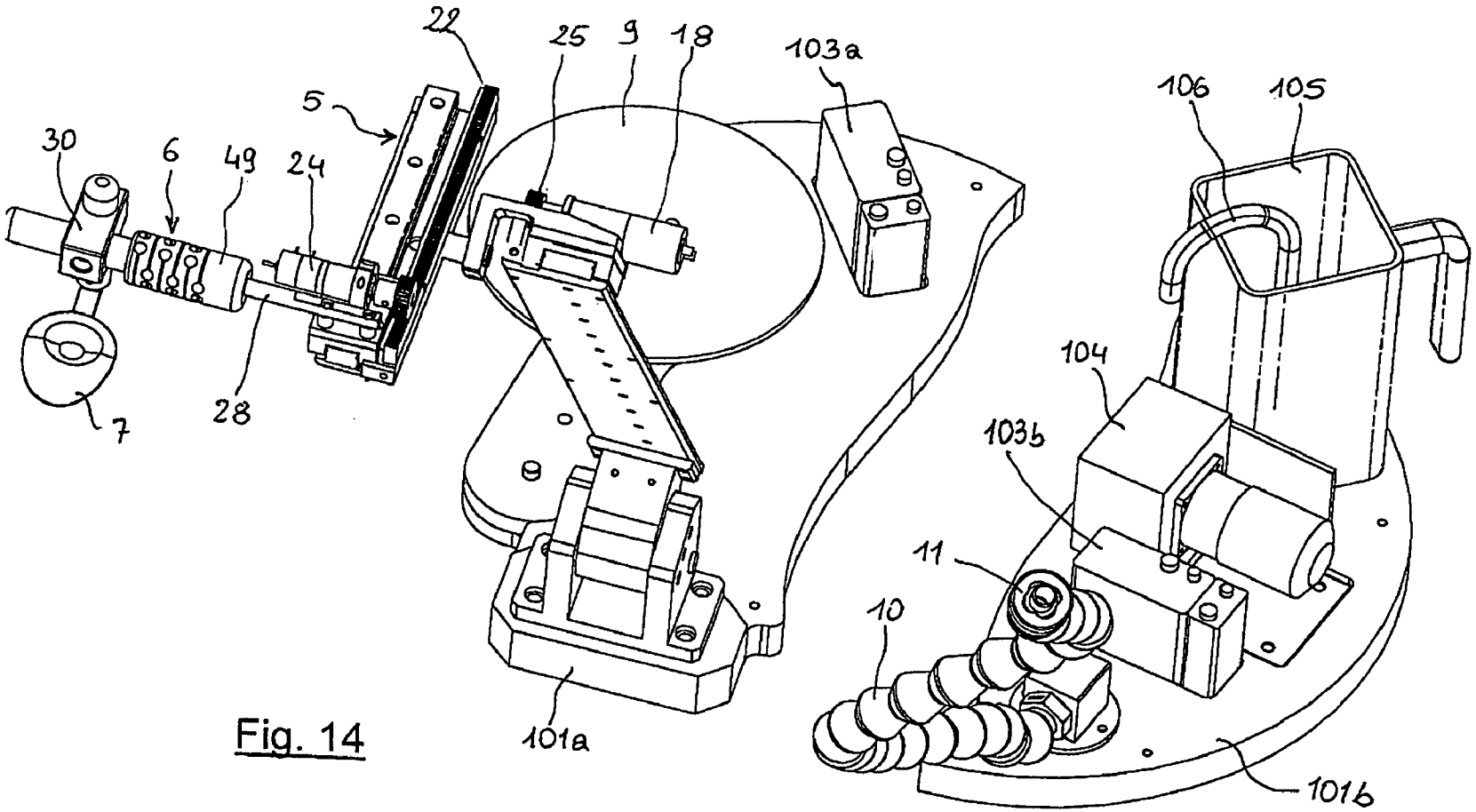

F*ig*. 3 is a perspective view of internal structure of a second arm of the apparatus illustrated in FIG. 1, the arm mounting a spoon;

FIG. 4 is a perspective view of the first and the second arms of FIG. 1 in an assembled configuration;

FIG. 5 is a perspective view of a plate holder of the apparatus, according to one aspect of the present invention;

FIG. 6 is a side sectional view of the plate holder shown in FIG. 5:

FIG. 7 is a perspective view of a mouth-operated control device of the apparatus illustrated in FIG. 1;

FIG. 8 is a sectional view, taken longitudinally, of the device shown in FIG. 7;

FIG. 9 is a block diagram showing operative interaction between various components of the present invention;

FIG. 10 is block diagram representing a liquid dispensing device according to the present invention;

FIG. 11 is a block diagram representative of a spoon moving device or system of the present invention;

FIG. 12 is a substantially front, perspective view of a simplified embodiment of an apparatus, according to the present invention;

FIG. 13 is a top perspective view of the apparatus shown in FIG. 12, separated into two parts; and FIG. 14 is a top perspective view showing the apparatus in the configuration set forth in FIG. 13, but without the external casing.

Still other objects and advantages of the present invention will become apparent from the following description of the preferred embodiments.

DETAILED DESCRIPTION OF THE PREFERRED EMBODIMENTS

Referring now to the drawings and, more particularly, to FIGS. 1-14, there is shown generally a specific, illustrative self-feeding apparatus, according to various aspects of the present invention. In one embodiment, illustrated in FIG. 1, the apparatus comprises a support base 1 for a box-type frame 1*a* containing tanks for liquid food and beverages as well as the apparatus electronics, and a first arm 3, slanted and connected to the base 1 through a rotoidal joint 4 allowing the inclination of arm 3 to be adjusted between two limit positions, i.e. a substantially vertical position and a substantially horizontal position. A second substantially horizontal arm 5, is mounted on the arm 3 in a longitudinally slidable fashion. On second arm 5 a support, generally indicated at 6, is mounted for a food scooping means, such as cutlery, in particular a spoon 7, the support 6 being also slidable longitudinally on second arm 5. Furthermore a third arm 8 extends horizontally from support base 1 and is equipped with a support 9 for a plate, not shown, or more in general a container for solid food to be fed to the disabled user through the spoon 7. From the free end of the first arm 3 a flexible tube 10 for feeding liquid and semi liquid food and beverages projects and ends with a control device 11 operable with the mouth by the user to control some functions of the apparatus. A control panel 12 with a LCD display 13 for visualizing the control menu of the different component systems of the apparatus is placed on the box-type frame 1*a*.

Figure 2:
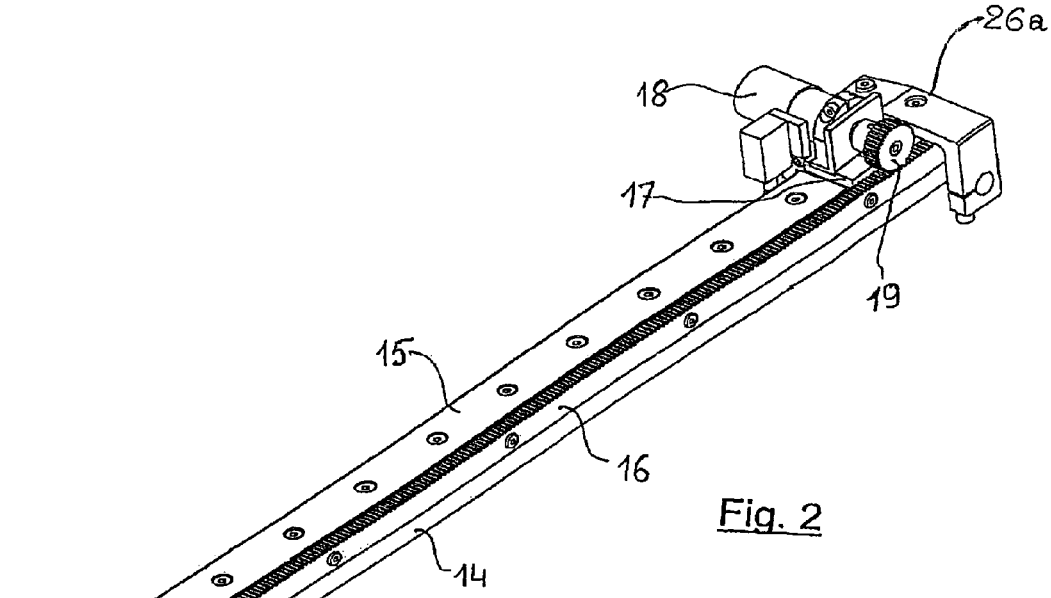
FIG. 2 is a perspective view of internal structure of a first arm of the apparatus illustrated in FIG. 1.
Figure 3:
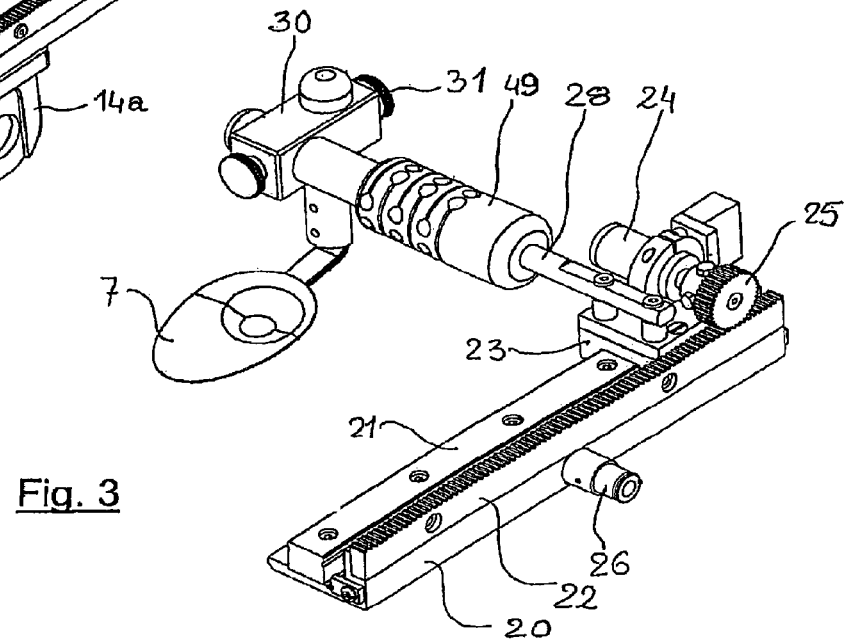

With reference to FIGS. 2, 3 and 4, the apparatus is equipped with a two-degree-of-freedom motion mechanical system comprising two linear guides embedded in the arms 3 and 5 respectively. In particular, arm 3 comprises internally an elongated support 14, on which a rail 15 and a rack 16 are mounted. On the rail 15 is mounted a carriage 17 of a ball linear guide. A DC motor 18 is mounted on carriage 17 transversely to rail 15 and a pinion 19 engaged with the rack 16 is fixed to the drive shaft of motor 18. The elongated support 14 is also provided with a bracket 14*a* at one end for the connection of arm 3 to the base 1 through the rotoidal joint 4.

Likewise, arm 5 comprises an elongated support 20 internally on which a rail 21 and a rack 22 are mounted. A carriage 23 of a ball linear guide is mounted on rail 21 and a DC motor 24, arranged transversely relative to the rail, is secured to carriage 23. A pinion 25 engaged with rack 22 is mounted to the drive shaft of the motor. The support is mounted to a bracket 26*a* integral with carriage 17 of the linear guide arranged in arm 3 through a pivot 26 passing through a longitudinal slot 27 formed along the arm. A fourth arm 28 extending perpendicularly from second arm 5, through a slot 29 formed longitudinally on second arm 5, is mounted to carriage 23 of the linear guide arranged on the second arm. The fourth arm has a connection 30 for spoon 7 or other cutlery. The position of the connection can be adjusted axially along arm 28 using a locking knob 31. Arm 28 is then joined to connection 30 through an elastic joint 49 fit to provide the food scooping utensil with suitable stiffness for allowing food to be scooped from the plate and transported, while, at the same time, adapting to sudden impacts without damaging the apparatus or injuring the disabled user. Elastic joint 49 advantageously allows the system to provide a reaction both in the direction perpendicular to the food container, thus preventing the spoon from breaking off against the container, and in the longitudinal direction, avoiding strong impacts against the mouth of the disabled user, as far as a maximum deformation beyond which an overload device is activated to compensate for any additional load.

The plate bearing device, with which the apparatus is equipped, is best seen in FIGS. 5 and 6. In particular, third arm 8 supports a DC motor 32 at its free end with a vertically positioned drive axis perpendicular to arm 3, and a plate 34 integral with plate support 9 mounted to drive shaft 33.

In the present embodiment of the invention two tanks 50 and 51 (schematically shown in FIG. 10 only) for liquid and semi liquid food and beverages, respectively, are placed inside the box-type frame 1*a*. Each tank is provided with a respective pump 52 and 53 (see FIG. 10), preferably of the peristaltic type, for dispensing the liquid contained in the relevant tank through a respective pipe extending within the first arm 3 and projecting from its free end with the flexible tube 10 at the height of the mouth of the disabled user.

The mouth operated control 11, set at the end of the flexible tube 10 and shown in detail in FIGS. 7 and 8, comprises a tube 35, through which the liquid to dispense flows, and a mobile sleeve 36, fitted in the flexible tube 10 coaxially to the tube 35 and bearing four mini-switches 38 arranged crosswise on its inner surface. The mini-switches 32 of the sleeve 36 can be connected to the device to be controlled by a cable or a flexible rip cord (not shown) applied on the sleeve and ending with a proper connector. The operation of the control 11, obtained by a relative movement of the tube 35 and the sleeve 36 to press selectively the mini-switches 38 like a joystick, allows the user to move through the menu shown in the display 13 of the control panel 12 and to select the wanted function. While control 11 is intended essentially for use by a disabled user, similar controls are provided, such as push buttons, on the control panel 12 which can be used by an assistant.

A block diagram showing the interaction of the various components of the system (control 11, two degree-of-freedom spoon motion system integrated with plate motion system, liquid dispenser and control panel 12) is shown in FIG. 9. The operation of the spoon motion system and the liquid dispenser can be controlled both through the control panel 12 and the mouth-operated control 11. Either systems can be separately used and for this reason each of them is equipped with an individual control system comprising a microcontroller and the necessary sensors and actuators. When the two systems are used together, at least a part of the user interface, i.e. the input/output peripheral units used by the disabled user (external sensors), is shared and is substantially constituted by the mouth operated control 11 and the control panel 12 with the display 13. These peripheral devices can be indifferently connected to either system through a connector 44 allowing the passage of the input/output signals between the two systems. On the other hand, it is necessary to avoid that both systems operate together to prevent conflict situations to occur. Indeed while there are no problems for the input, as far as the output is concerned it is requested that the system, not active at a certain time, put its outputs to high impedance. To be sure that only one of the systems be active, a control group 45 is provided for receiving signals from the system that is active at that time and on the basis of these signals determines which of them must be active.

A block diagram of the liquid dispensing unit is shown in FIG. 10. The unit is equipped with a control electronic board 39 for selectively operating the two pumps, which the unit is equipped of, to dispense the liquids stored in the tanks. In particular, the dispensing unit is both electrically and mechanically connected to the other parts of the system through three connectors 40, 41 and 42 connected to the display, the spoon motion system and, respectively, the mouth operated control 11.

The block diagram of the spoon motion system is shown in FIG. 11. A control board 43 is provided for receiving signals from encoders which motors 18 and 24 are equipped of and from the end-of-stroke sensors, in particular of the Hall-effect type, so as to correctly drive the trajectory of the spoon from the plate to the user's mouth and vice versa. The same board also controls the rotation of the motor 32 of the plate holder 9. Even in this case three connectors 46, 47 and 48 are provided for the electrical and mechanical connection between the control board 43 and the dispensing unit and the control 11. The position control is of the closed-cycle type, while the velocity control is of the open-cycle type. The encoders detect the position of the two links and the control system moves the motors through PWM to reach the wanted position. In some parts of the spoon trajectory speed changes are provided to the end of improving the food scooping movement and the transfer movement to the user's mouth. The liquid dispensing system and the spoon and plate motion systems are provided with a specific software to implement the respective functions and display suitable menus to the user.

The feeding cycle comprises a step in which the second arm 5 moves towards the plate, or other open food container, placed on the plate holder 9 with the spoon 7 at the distal end-of-stroke position of the arm 5. The spoon 7 then moves along the second arm 5 towards its proximal end-of-stroke position to scoop food in the plate. To this point the second arm 5 start to slide going up along the first arm 3 until it reaches the free end of arm 3 leading the spoon 7 at the height of the user's mouth. When the spoon comes back towards the plate, the plate holder 9 performs an angular displacement of a prefixed angle to allow the spoon to collect food in a different sector of the plate. By means of an initial calibration procedure the above movements can be adjusted in an optimal way, as well as the rotation type (continuous or intermittent), the rotation width, the spoon position (plate bottom or plate edge).

Advantageously the apparatus according to the invention is equipped with a resistor (not shown) embedded in the rotary plate holder, by which food can be kept warm all over the user meal.

Furthermore, the apparatus according to the invention is equipped with a push-button alarm device for an aid request in case of choking, by which all the system motors are switched off.

The self-feeding apparatus for disabled people according to the invention has a familiar look, typical of a household appliance, and is designed to use regular plates and cutlery. It is not very noisy and of such low dimensions as to be placed on a table, a bed or a wheel chair. It is portable and light, easy to handle and dismount, battery powdered, water proof and easy to clean (some of its components can be washed in a dishwashing machine).

The apparatus according to the invention is also easy to program and calibrate through automatic or servo guided movements, so as to be easily usable by several user in Rehabilitation Centers and is designed especially to stimulate the active participation (physiatric training during feeding) of the user.

The apparatus according to the invention can perform the requested tasks with continuity and in a time comparable to the human gesture of feeding, enabling the user to choose when and what to eat by rotating the plate and to drink without the aid of an assistant or simply to autonomously feed himself or herself by intake of liquid food.

FIGS. 12, 13 and 14 show another embodiment of the apparatus according to the invention designed to the aim of simplifying its structure, yet maintaining all the essential functions and adding the possibility of physically separate the part of the apparatus intended for feeding solid or semisolid food from the part for feeding liquid food and beverages. In these figures the components of the apparatus equal to those of the apparatus shown in FIGS. 1-11 are referred with the same reference numbers and will be not described further on.

In the apparatus according to the embodiment shown in the FIGS. 12, 13 and 14 the support base is formed by two parts 101*a* and 101*b*, releasably connected to one another by connection means, for example of the snap-on type, of any known type. Box-like frames 102*a* and 102*b* stand on base parts 101*a* and 101*b* respectively and act as casing for the electronics, batteries 103*a* and 103*b* and a pump 104 with relevant motor for liquid food or beverage contained in an outer, removable vessel 105 in which a tube 106 connected to the pump is dipped. The arm 3 for moving the spoon 7 and the rotary arm 8 bearing the food plate holder 9 extend from base 101*a*. A slot 107 is formed on casing 102*a* to house the plate holder 9 and the relevant rotary arm 8 when the apparatus is not in use. The flexible tube 10 coming from pump 104 and ending with a mouth-operated control 11 extends from base 101*b*.

Set up buttons for the apparatus calibration and LED's 108 indicating the on/off condition of the system, the battery charge status and the calibration conditions (i.e. they indicate when the calibration menu is active and when the two scooping positions of the spoon have been saved) are also available on casing 102*a*. On the casing 102*b* there are available LED's 109 indicating the on/off condition and the battery charge status as well as a trimmer, not shown, to vary the pump speed. The operating start of the apparatus is obtained through a push-button connected via a jack, not shown, placed in the rear part of casing 102*a*.

Various modifications and alterations to the invention may be appreciated based on a review of the disclosure. These changes and additions are intended to be within the scope and spirit of the invention as defined by the following claims.

What is claimed is:

1. A self-feeding apparatus for the disabled and elderly, which comprises: a support base; a holder for an open food container, pivotally connected to the base; an article for scooping food from the container; a system for moving the scooping article from a food scooping position from the container and a food dispensing position at a selected height from the base corresponding to the user's mouth, the system comprising a first arm slantingly extending from the base and a second arm, arranged in a substantially horizontal position and slidably mounted on the first arm, the food scooping article being slidably mounted on the second arm; a motor being further provided for sliding the second arm along the first arm and the food scooping article along the second arm and for rotating the food container holder; at least one tank for liquid or semi-liquid food and for beverages being placed on the base, a conveyor being provided for transporting the liquid or semi-liquid food from the tank to the user's mouth; and a programming and control system that includes a mouth operable control at the outlet end of the conveyor.

2. A self-feeding apparatus for the disabled and elderly, which comprises: a support base; a holder for an open food container, pivotally connected to the base; an article for scooping food from the container; a system for moving the scooping article from a food scooping position from the container and a food dispensing position at a selected height from the base corresponding to the user's mouth, the system comprising a first arm slantingly extending from the base and a second arm, arranged in a substantially horizontal position and slidably mounted on the first arm, the food scooping article being slidably mounted on the second arm; a motor being further provided for sliding the second arm along the first arm and the food scooping article along the second arm and for rotating the food container holder; at least one tank for liquid or semi-liquid food and for beverages being placed on the base, a conveyor being provided for transporting the liquid or semi-liquid food from the tank to the user's mouth; and a programming and control system that includes a mouth operable control at the outlet end of the conveyor, wherein the conveyor for transporting liquid or semi liquid food and beverages includes a pump in communication with the respective tank and a food conveying conduit to the height corresponding to the position of the user's mouth.

3. The apparatus set forth in claim 2, wherein the system for moving the food scooping article comprises a first linear guide arranged in the first arm, with which the second arm is integral, and a second linear guide in the second arm to which the food scooping article is integrally connected.

4. The apparatus set forth in claim 2, wherein the holder for a open food container comprises a third arm pivotally connected to the base and a bearing motor for either continuously or intermittently rotating a holding plane for the container.

5. The apparatus set forth in claim 2, wherein the food scooping article includes a fourth arm extending from the second linear guide and a connection for a cutlery tool locked on the third arm in an axially adjustable position on the arm.

6. The apparatus set forth in claim 5, wherein the connection for the tool is affixed to the fourth arm by an elastic joint.

7. The apparatus set forth in claim 2, wherein a device is provided between the base and the first arm for adjusting the inclination of the first arm.

8. The apparatus set forth in claim 2, wherein the first and second linear guides each comprises a carriage supporting the respective motor, such motor being connected to a pinion engaged on a rack mounted on the respective arm.

9. The apparatus set forth in claim 2, wherein the mouth operable control is positioned at the free end of the liquid food conduit and comprises a tube and a sleeve coaxial with the tube, engaged within the conduit and selectively contactable with angularly equi-spaced miniswitches for actuating the functions desired.

10. The apparatus set forth in claim 2, wherein a heater is generally embedded in the open food container holder.

11. The apparatus set forth in claim 2, further comprising an alarm device for making a request for assistance.

12. The apparatus set forth in claim 2, wherein a display, mounted to the base, allows visual inspection of the system functions by the user.

13. The apparatus set forth in claim 2, wherein the system for moving the food scooping article and for moving the food container holder, on the one hand, and the liquid food conveyor, on the other hand, are each equipped with a respective independent control device and are connected to the mouth operable control and the display, a control unit between the independent control device being provided for determining which of them must be in operation, preventing both of the respective independent control devices from being in operation at the same time.

14. The apparatus set forth in claim 2, wherein the support base is formed by two releasably connected parts, the food scooping article and the food container holder being supported by one of the parts, the tank for liquid food and the conveyor for transporting liquid food from the tank to a height corresponding to the position of the user's mouth being supported by the other one of the parts.

15. A self-feeding apparatus for the disabled and elderly, which comprises: a support base; a holder for an open food container, pivotally connected to the base; an article for scooping food from the container; a system for moving the scooping article from a food scooping position from the container and a food dispensing position at a selected height from the base corresponding to the user's mouth, the system comprising a first arm slantingly extending from the base and a second arm, arranged in a substantially horizontal position and slidably mounted on the first arm, the food scooping article being slidably mounted on the second arm; a motor being further provided for sliding the second arm along the first arm and the food scooping article along the second arm and for rotating the food container holder; at least one tank for liquid or semi-liquid food and for beverages being placed on the base, a conveyor being provided for transporting the liquid or semi-liquid food from the tank to the user's mouth; and a programming and control system that includes a mouth operable control at the outlet end of the conveyor, wherein the mouth operable control is positioned at the free end of the liquid food conduit and comprises a tube and a sleeve coaxial with the tube, engaged within the conduit and selectively contactable with angularly equi-spaced miniswitches for actuating the functions desired.

16. A self-feeding apparatus for the disabled and elderly, which comprises: a support base; a holder for an open food container, pivotally connected to the base; an article for scooping food from the container; a system for moving the scooping article from a food scooping position from the container and a food dispensing position at a selected height from the base corresponding to the user's mouth, the system comprising a first arm slantingly extending from the base and a second arm, arranged in a substantially horizontal position and slidably mounted on the first arm, the food scooping article being slidably mounted on the second arm; a motor being further provided for sliding the second arm along the first arm and the food scooping article along the second arm and for rotating the food container holder; at least one tank for liquid or semi-liquid food and for beverages being placed on the base, a conveyor being provided for transporting the liquid or semi-liquid food from the tank to the user's mouth; and a programming and control system that includes a mouth operable control at the outlet end of the conveyor, wherein the inclination of the first arm is adjustable for proper positioning of the spoon in the food dispensing position.

* * * * *